US006814469B2

(12) United States Patent
Patrick, III

(10) Patent No.: US 6,814,469 B2
(45) Date of Patent: Nov. 9, 2004

(54) ROTATING REFLECTOR

(75) Inventor: Ellis W. Patrick, III, Sharpsburg, GA (US)

(73) Assignee: Cooper Industries, Inc., Houston, TX (US)

( * ) Notice: Subject to any disclaimer, the term of this patent is extended or adjusted under 35 U.S.C. 154(b) by 244 days.

(21) Appl. No.: 09/778,754

(22) Filed: Feb. 8, 2001

(65) Prior Publication Data

US 2003/0007353 A1 Jan. 9, 2003

Related U.S. Application Data

(60) Provisional application No. 60/212,647, filed on Jun. 19, 2000.

(51) Int. Cl.[7] ..... F21V 7/00; F21V 17/02

(52) U.S. Cl. ..... 362/277; 362/319; 362/296; 362/341

(58) Field of Search ..... 362/277, 282, 362/284, 287, 288, 427, 514, 515, 319, 322, 324, 289

(56) References Cited

U.S. PATENT DOCUMENTS

| | | | | | |
|---|---|---|---|---|---|
| 1,996,126 | A | | 4/1935 | Sipp | 362/277 |
| 2,064,880 | A | | 12/1936 | Bostic | 362/284 |
| 2,320,884 | A | | 6/1943 | Pennow | 362/298 |
| 3,538,324 | A | | 11/1970 | Hankins | 362/277 |
| 3,852,587 | A | * | 12/1974 | Koehler | 240/60 |
| 3,900,726 | A | | 8/1975 | Tichenor | 240/41.35 R |
| 4,277,818 | A | * | 7/1981 | Urbanek et al. | 362/61 |
| 4,503,486 | A | * | 3/1985 | Makita | 362/515 |
| 4,947,297 | A | | 8/1990 | Druffel et al. | 362/147 |
| 5,077,641 | A | * | 12/1991 | Schmidt et al. | 362/61 |
| 5,426,575 | A | | 6/1995 | Richards | 362/283 |
| 5,564,815 | A | | 10/1996 | Littman et al. | 362/147 |
| D379,546 | S | | 5/1997 | Littman | D26/74 |
| 5,803,585 | A | * | 9/1998 | Littman et al. | 362/147 |
| 5,908,236 | A | | 6/1999 | Lueken et al. | 362/364 |
| 6,036,337 | A | | 3/2000 | Belfer | 362/287 |

* cited by examiner

*Primary Examiner*—Thomas M. Sember
*Assistant Examiner*—Bao Q. Truong
(74) *Attorney, Agent, or Firm*—Thomas, Kayden, Horstemeyer & Risley LLP

(57) ABSTRACT

An adjustable light fixture includes a housing, a reflector assembly, and an adjustment mechanism. The housing has an external surface and an interior compartment. The reflector assembly is positioned within the interior compartment of the housing. The adjustment mechanism is adjustable from the external surface of the housing to cause movement of the reflector relative to the housing.

34 Claims, 7 Drawing Sheets

ROTATING REFLECTOR

RELATED APPLICATIONS

This application claims priority from U.S. Provisional Application No. 60/212,647 filed on Jun. 19, 2000, and which is incorporated herein by reference in its entirety.

TECHNICAL FIELD

This invention relates to a light fixture with a rotatable reflector.

BACKGROUND

Light fixtures that are mounted to walls can be used to illuminate the wall or an area below the fixture in a direction away from the wall. A light fixture typically includes a housing, a reflector, a lamp socket, and a lamp. The throw of the light can be adjusted to illuminate more of the wall or more of the area away from the wall. Typically, the adjustment involves adjusting the housing to change the position of the reflector. Because the lamp socket is mounted on the reflector, adjusting the housing causes the light produced by the lamp to have a throw in the direction in which the reflector is aimed.

SUMMARY

In one general aspect, an adjustable light fixture includes a housing, a reflector assembly, and an adjustment mechanism. The housing includes an external surface and an interior compartment. The reflector assembly is positioned within the interior compartment of the housing. The adjustment mechanism is operable from outside the external surface of the housing to cause movement of the reflector relative to the housing.

Embodiments of the adjustable light fixture may include one or more of the following features. For example, the adjustable light fixture may include a channel through the housing that connects the interior compartment to the external surface of the housing, and the adjustment mechanism may extend through the channel from the interior compartment to the external surface of the housing. The adjustment mechanism may be attached to the reflector assembly. The adjustable light fixture may further include a light socket fixture positioned in the interior compartment of the housing.

The reflector assembly may include a frame and the adjustment mechanism may be attached to the frame. The frame may be attached to the housing such that the attachment of the frame to the housing allows movement of the frame relative to the housing. The attachment of the frame to the housing may include a hinge. The reflector assembly may further include a reflector that is attachable to the reflector frame.

The adjustment mechanism may include one or more screw assemblies that are configured to move the reflector assembly relative to the housing. The one or more screw assemblies are rotatable to move the reflector. The adjustment mechanism may further include a swivel bolt, and the housing and the reflector assembly may be connected to the swivel bolt.

In another general aspect, adjusting a reflector assembly includes providing a housing, providing a reflector assembly, providing an adjustment mechanism, and adjusting the adjustment mechanism to move the reflector assembly. The housing includes an external surface and an interior compartment. The reflector assembly is positioned within the interior compartment of the housing. The adjustment mechanism is operable from outside the external surface of the housing to move the reflector assembly within the interior compartment of the housing.

Embodiments may include one or more of the features noted above and one or more of the following features. For example, the reflector assembly may be attached to the housing, the adjustment mechanism may be attached to the reflector assembly, and adjusting the adjustment mechanism may move the reflector assembly relative to the housing. The reflector assembly may include a frame and adjusting the adjustment mechanism may involve moving the frame.

The adjustment mechanism may include two screw assemblies that are designed to move the reflector assembly relative to the housing such that adjusting the adjustment mechanism includes rotating the two screw assemblies. The adjustment mechanism may further include a swivel bolt connecting the housing and the reflector assembly, and adjusting the adjustment mechanism swivels the reflector assembly relative to the housing.

The rotating reflector is contained inside the light fixture housing for use as architectural lighting to upwardly wash a wall or to downwardly illuminate the ground. Because the button head of the jack screw is external to the housing, adjustments can be made to rotate the reflector from outside the housing without having to access the interior compartment of the housing. Thus, the reflector can be rotated while maintaining the housing and lens assembly in a fixed position. This also eases assembly and lowers the cost of manufacturing the light fixture since the housing can be made of one piece and requires fewer seals.

The details of one or more embodiments of the invention are set forth in the accompanying drawings and the description below. Other features and advantages of the invention will be apparent from the description, the drawings, and the claims.

DESCRIPTION OF DRAWINGS

Like reference symbols in the various drawings indicate like elements.

DETAILED DESCRIPTION

Figure 1:
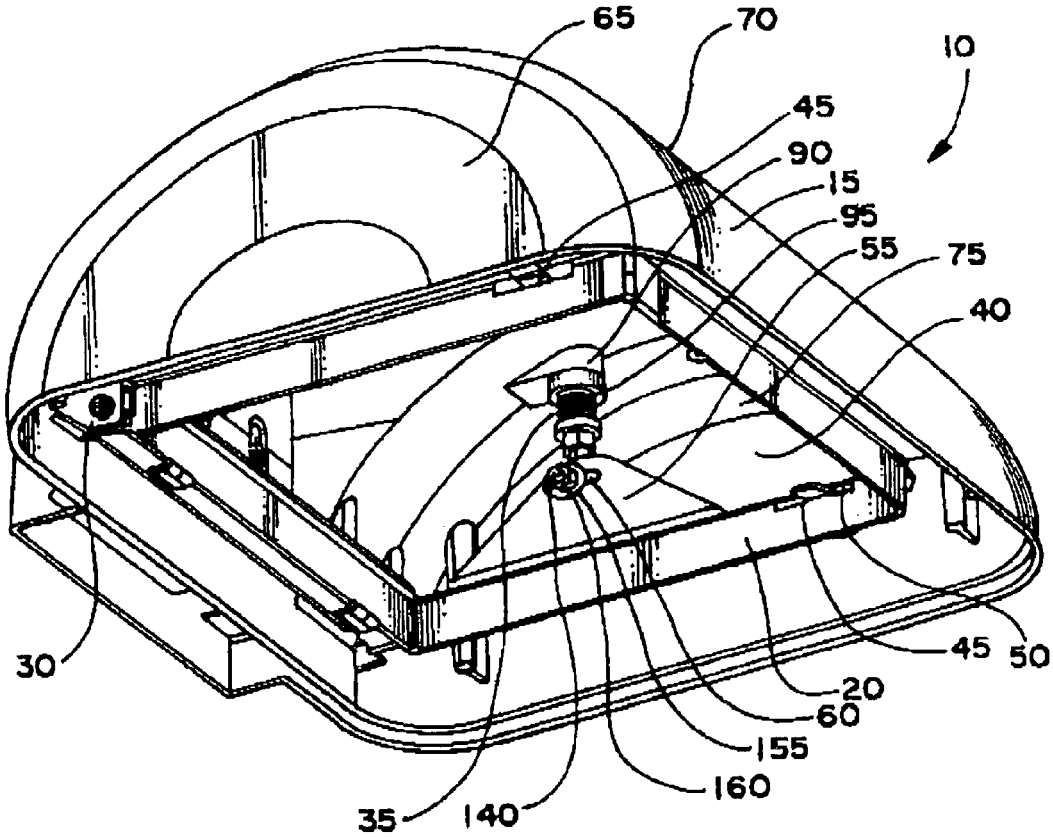
FIG. 1 is a perspective view of a light fixture.

Referring to FIGS. 1–4, a light fixture 10 includes a housing 15 and a reflector assembly that includes a reflector frame 20 and a reflector 25. The reflector assembly is rotatably attached to the housing 15 at one location by a frame hinge 30 on the reflector frame 20 and at a second location by a jack screw 35. The jack screw functions as an adjustment mechanism to permit movement of the reflector frame from a position outside of the housing.

The reflector frame 20 is a rigid square frame with an opening 40 formed by the frame perimeter. The reflector frame attaches to the frame hinge 30 at two adjacent corners to define a rotation axis. The reflector frame includes a pair of pivot arms 45 and a pair of pivot arm slots 50 in which the pivot arms pivot. The pivot arms 45 and pivot arm slots 50 are located in proximity to the two corners opposing the rotation axis of the reflector frame. The reflector frame 20 also includes a crank arm 55 that extends from the frame and includes a slotted opening 60.

Figure 4:
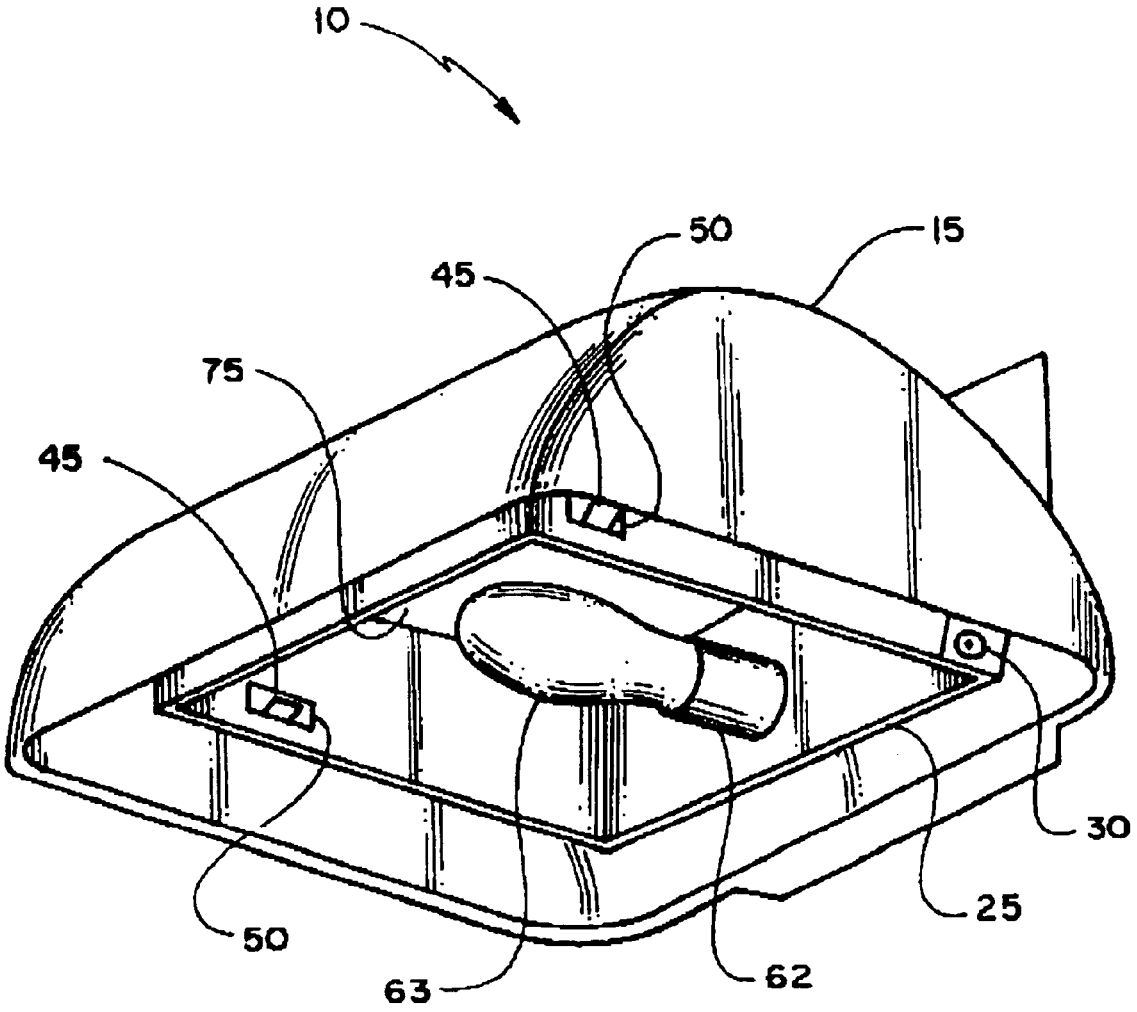
FIG. 4 is a perspective view of the light fixture of FIG. 1 with a lamp installed.

The reflector 25 is mounted on the reflector frame 20 by placing the reflector within the opening 40 of the reflector frame and pivoting the pair of pivot arms 45 into respective slots (not shown) in the reflector 25. The reflector 25 includes multiple pairs of slots so that the orientation of the reflector relative to the reflector frame 20 can be varied by, for example, 90°, 180°, or 270°. As shown in FIG. 4, a lamp socket 62 and a lamp 63 pass through the reflector 25 into the housing.

Figure 5:
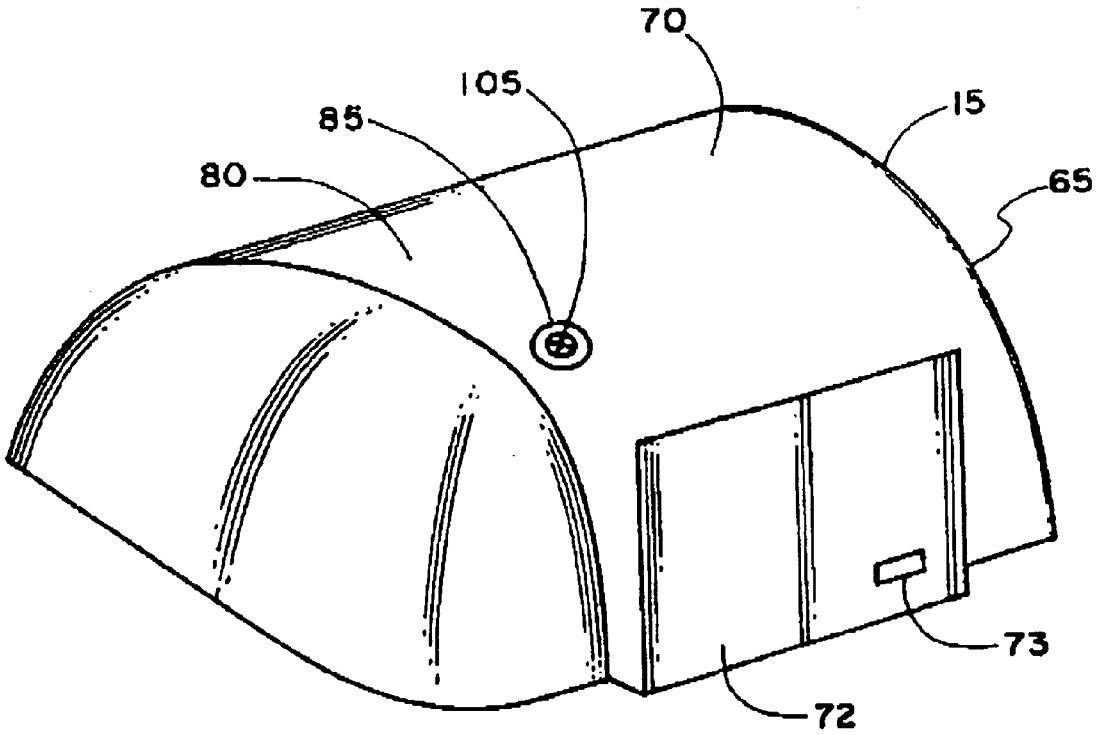
FIG. 5 is a top perspective view of the housing of the light fixture of FIG. 1 showing a button head of the jack screw of FIG. 2.
Figure 6:
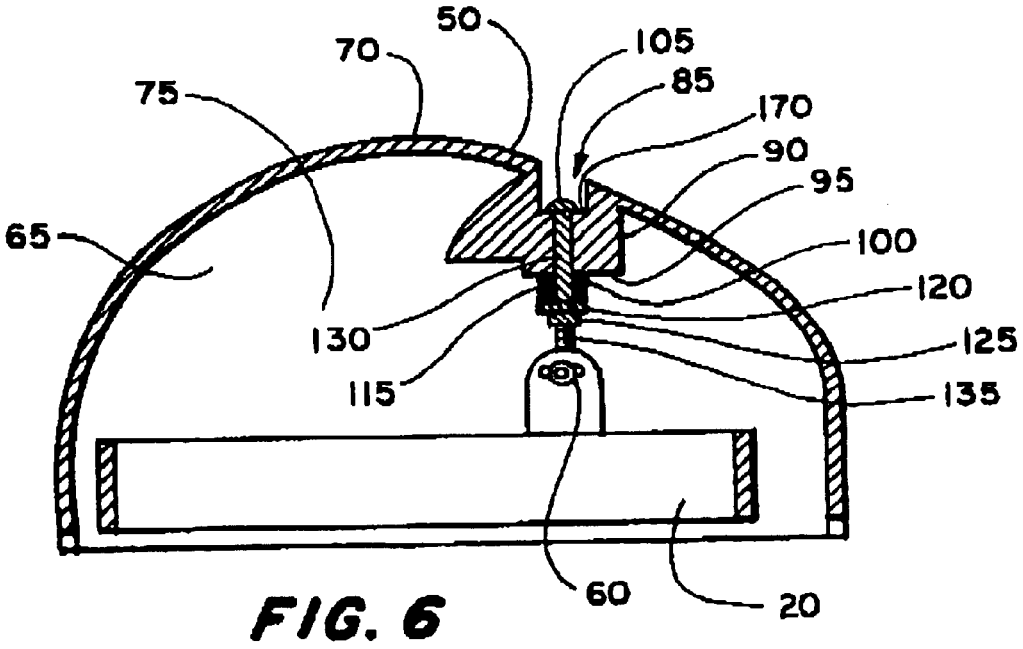
FIG. 6 is a cross-sectional side view of the housing of FIG. 5.

Referring also to FIGS. 5 and 6, the housing 15 has a cylindrical shape that is formed by a pair of flat sides 65 at each end and an arched middle portion 70 from which the sides 65 extend to define an inner compartment 75 in which the reflector frame 20 and the reflector 25 are positioned. The middle portion 70 has a mounting plate 72 for mounting to, for example, a wall, and an opening 73 for running electrical wires to the lamp socket 62. The middle portion 70 also has an upper external surface 80 that includes a channel 85 that extends into the inner compartment 75 of the housing 15. In the inner compartment, the channel 85 appears as a vertical tube 90 that terminates in the housing as a lip 95 that defines a lower opening 100 into the channel 85. The jack screw 35 is mounted to the crank arm 55 at one end and to the housing 15 at the other end. Although the housing 15 is shown as having a cylindrical shape, in other embodiments, the housing 15 may have, for example, a square, rectangular, semi-globe or conical shape.

Figure 7:
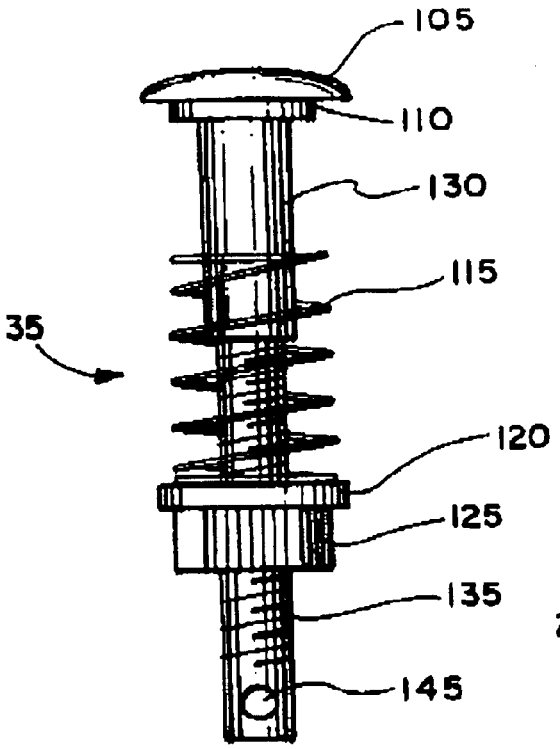
FIG. 7 is a side view of the jack screw of FIG. 2.

Referring also to FIG. 7, the jack screw 35 includes a button head 105, a washer or o-ring 110, a compression spring 115, a spring cup 120, a nut 125, an upper shaft 130, and a lower threaded shaft 135. The upper shaft 130 has a threaded inner channel that is configured to threadably receive the lower threaded shaft 135. The compression spring 115 surrounds the upper shaft 130 and part of the lower threaded shaft 135 and rests against the top of the spring cup 120. The bottom of the spring cup 120 rests against the nut 125.

Figure 2:
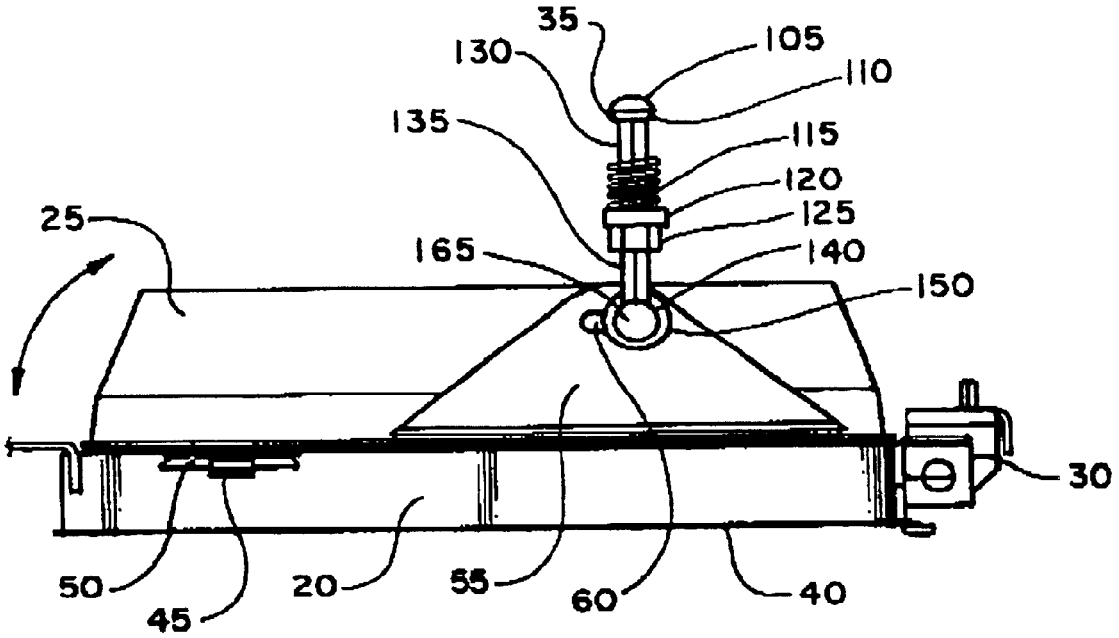
FIG. 2 is a side view of a jack screw mounted to a reflector frame of the light fixture of FIG. 1.
Figure 3:
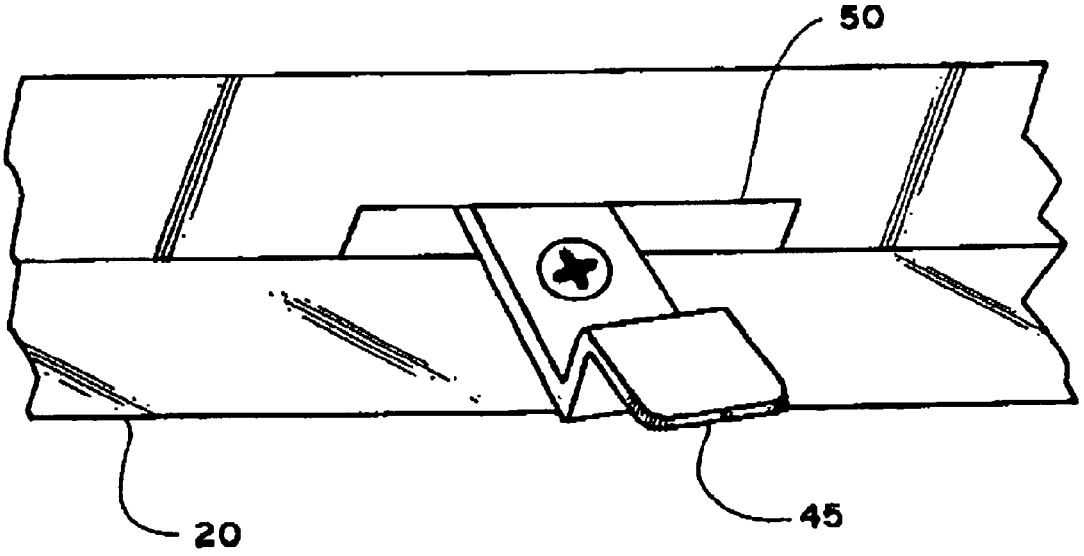
FIG. 3 is an enlarged perspective view of a pivot arm of the reflector frame of FIG. 2.

A swivel bolt 140 (FIG. 1) passes through a channel 145 in the jack screw 35 at the bottom of the lower threaded shaft 135 and is configured to swivel within the channel 145. As shown in FIGS. 1 and 2, the swivel bolt 140 is oriented in the channel 145 so as to be substantially perpendicular to the lower threaded shaft 135. The swivel bolt 140 passes from the shaft 135 and through a washer 150 into and through the slotted opening 60 in the crank arm 55. A washer 155 and a nut 160 are threadably mounted to the swivel bolt 140 on the opposite side of the crank arm 55 to retain the swivel bolt in the slotted opening. A head 165 of the swivel bolt 140 retains the bolt in the channel 145.

As shown in FIG. 6, the upper shaft 130 passes through the channel 85 in the housing 15 such that the button head 105 and the washer 110 rest against an upper lip 170 in the channel 85. Rotating the jack screw 35 by turning the button head 105 causes the upper shaft 130 to threadably receive or expel the lower threaded shaft 135 to raise or lower, respectively, the reflector frame 20, which causes the reflector frame 20 to rotate about the axis defined by the hinges 30. With the reflector 25 mounted to the reflector frame 20, the throw or direction of the light is varied by the adjustment of the reflector frame. In this manner, the throw of the light can be varied by accessing the jack screw 35 from a location external to the housing rather than from an internal location.

Figure 8:
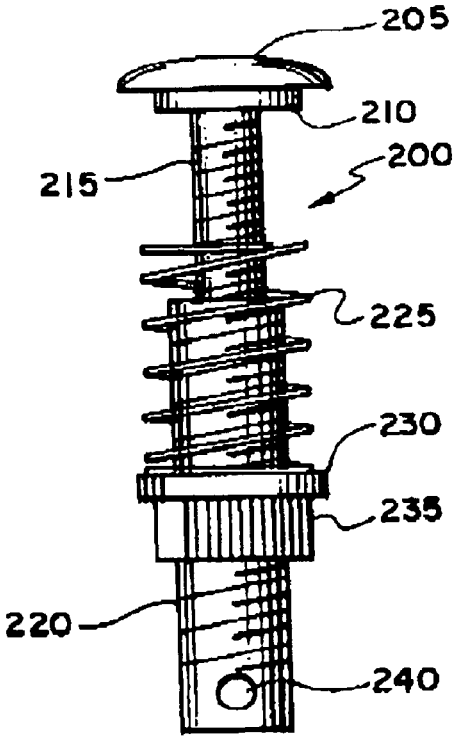
FIGS. 8 and 9 are side views of alternative jack screws.

Referring to FIG. 8, an alternative jack screw 200 for raising and lowering the reflector frame 20 includes a button head 205, a washer 210, an upper threaded shaft 215 that is configured to be threadably received in a lower threaded shaft 220, a compression spring 225, a spring cup 230, and a nut 235. The lower threaded shaft 220 includes a channel 240 through which the swivel bolt 140 is passed when the jack screw 200 is used with the housing 10 in place of the jack screw 35. Rotating the button head 205 causes the upper threaded shaft 215 to be threadably inserted or expelled from the lower threaded shaft 220, which causes the reflector frame 20 to be raised or lowered, respectively.

Figure 9:
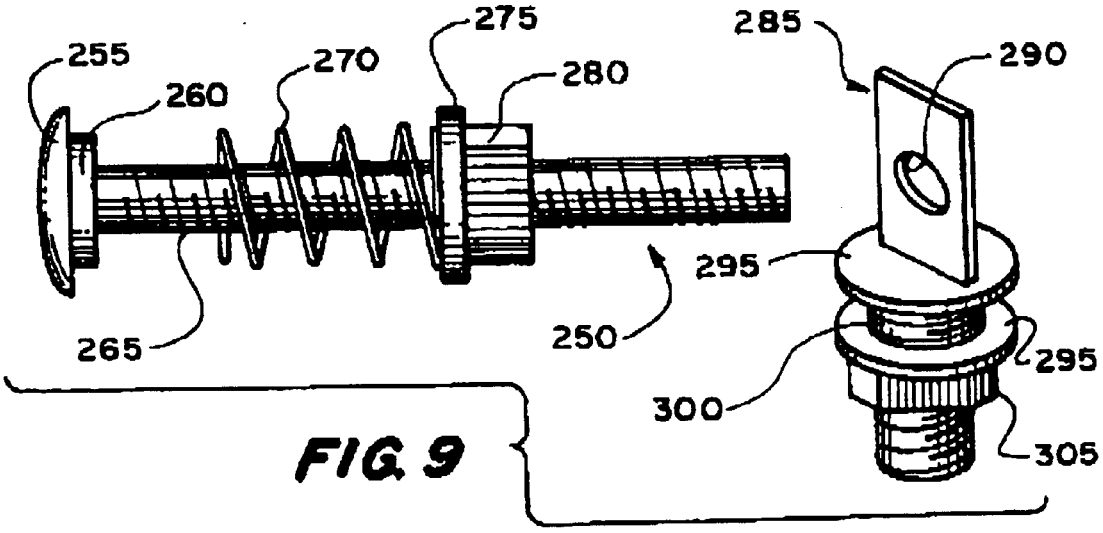

Referring to FIG. 9, another alternative jack screw 250 for raising and lowering the reflector frame 20 includes a button head 255, a washer 260, a threaded shaft 265, a compression ring 270, a spring cup 275, and a nut 280. The screw 250 is used with a swivel bolt 285 to retain the screw to the crank arm 55. The swivel bolt 285 includes a threaded channel 290 that is configured to threadably receive the threaded shaft 265. A pair of washers 295 are placed on the swivel bolt 285 and on opposite sides of the crank arm 55. The swivel bolt also includes a threaded section 300 on which a nut 305 is threadably attached. When the screw 250 is threadably installed in the swivel bolt 285 and the nut 305 is threadably installed on the threaded section 300, the washers 295 are retained on the swivel bolt by the screw 250 and the nut 305.

When used with the housing 15, rotating the button head 255 causes the threaded shaft 265 to threadably pass up or down through the threaded channel 290 to lower or raise, respectively, the reflector frame 20. The nut 280 is adjusted on the threaded shaft 265 to cause the spring 270 to be under different amounts of compression.

Figure 10:
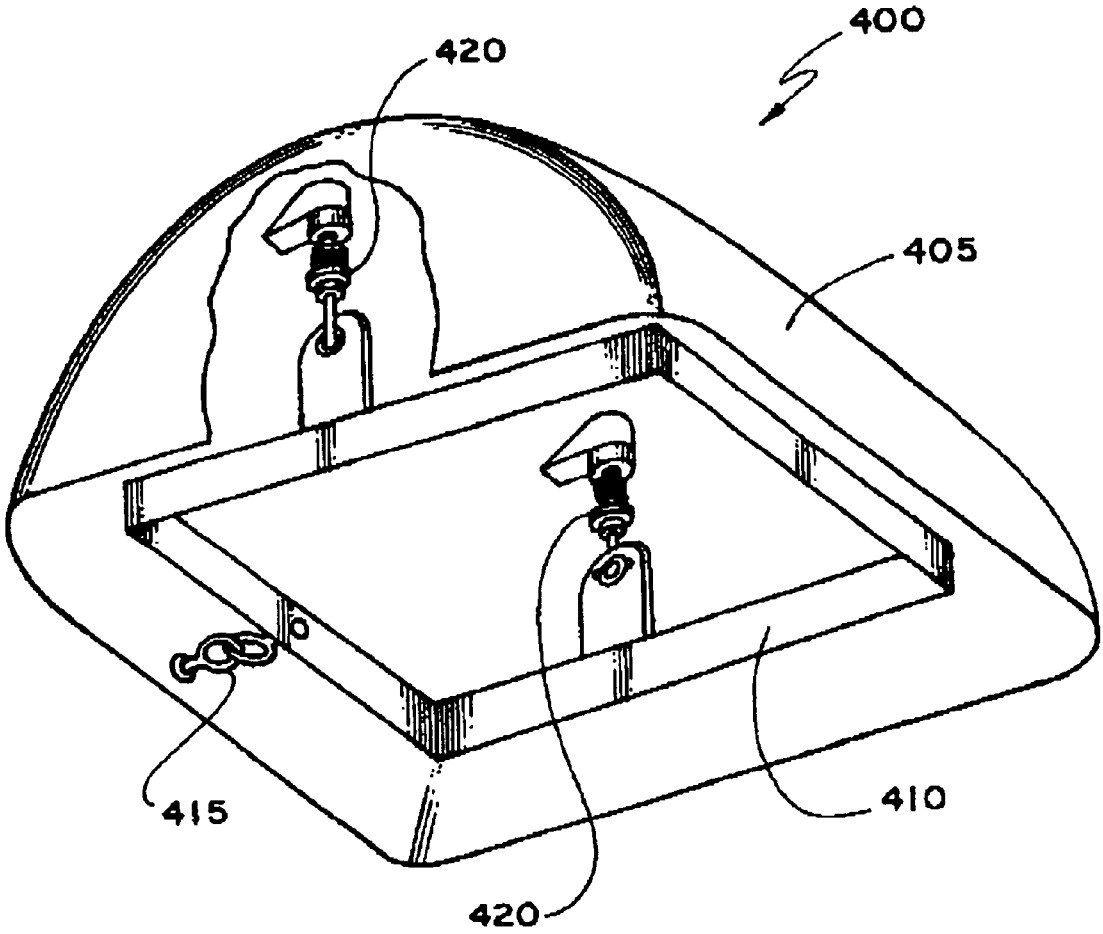
FIG. 10 is a perspective view of a housing having a dual jack screw rotation mechanism.
Figure 11:
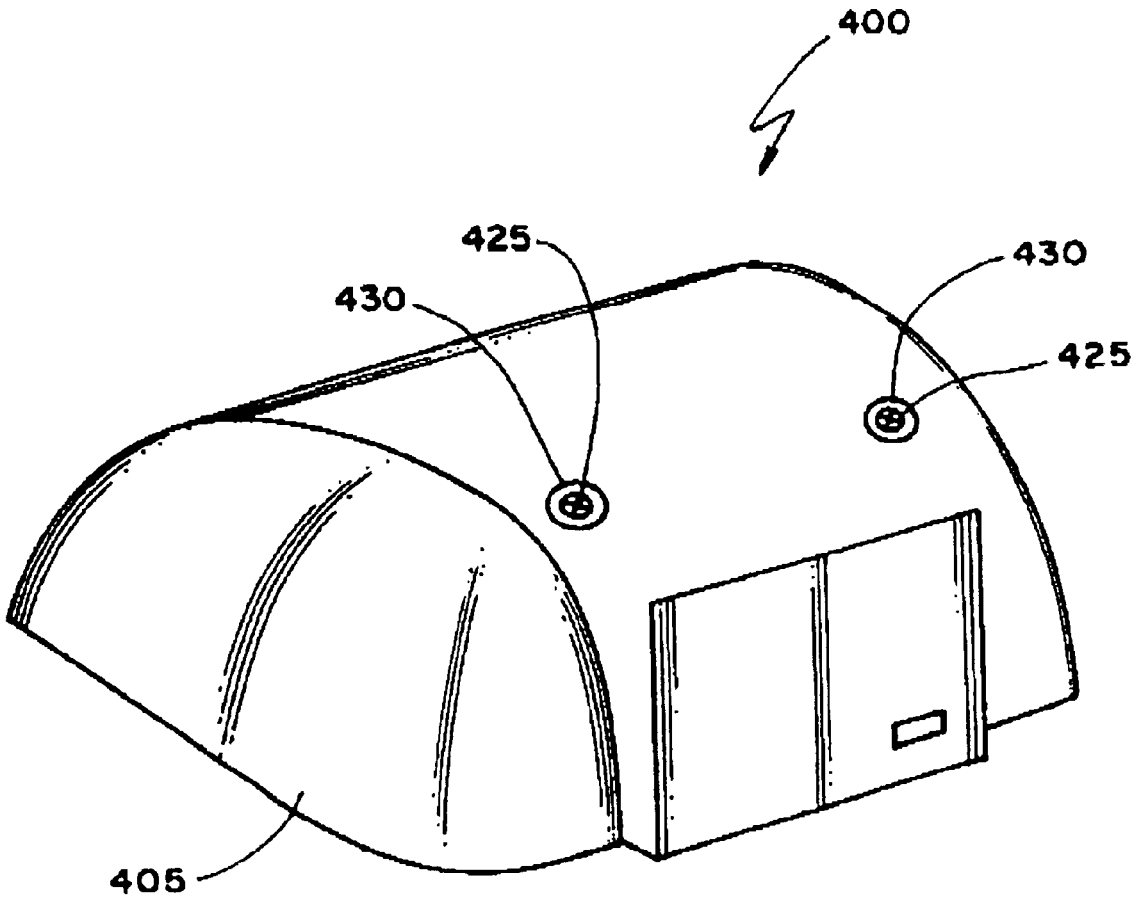
FIG. 11 is a top perspective view of the housing of FIG. 11.

Referring to FIGS. 10 and 11, a light fixture 400 includes a housing 405, a reflector 410, an eyelet connection 415, and a pair of jack screws 420 that have button heads 425 in channels 430. The button heads 425 are accessed at positions external to the housing. In this manner, the throw of the light from a lamp mounted in the lighting fixture 400 can be adjusted by rotating the jacks screws 420 to a similar degree. The throw of the light also can be controlled by rotating the jack screws 420 by different amounts. For example, one jack screw can be tightened to cause the throw of the light to be in the direction in which that jack screw is positioned.

Components of the light fixture 10 and the light fixture 400 may be made of heat resistant plastic or metal. For example, the housing 15 can be made of a molded plastic or metal.

A number of embodiments of the invention have been described. Nevertheless, it will be understood that various modifications may be made without departing from the spirit and scope of the invention. For example, the external adjustment mechanism can be used on a street lighting fixture, runway lighting fixture, or flood light. An adjustment mechanism to rotate the reflector, such as the jack screw described above, can be attached to the reflector instead of to the reflector frame so as to directly rotate the frame by operating the adjustment mechanism. Accordingly, other embodiments are within the scope of the following claims.

What is claimed is:

1. An adjustable light fixture comprising:

a housing with an external surface and an interior compartment;

a lamp socket contained entirely within the housing;

a reflector assembly rotatably attached to the housing within the interior compartment of the housing; and an adjustment mechanism that is operable from the external surface of the housing to cause movement of the reflector assembly relative to the housing into a continuous range of operating positions.

2. The adjustable light fixture of claim 1 further comprising a channel through the housing connecting the interior compartment to the external surface of the housing, wherein the adjustment mechanism extends through the channel from the interior compartment to the external surface of the housing.

3. The adjustable light fixture of claim 1 wherein the adjustment mechanism is attached to the reflector assembly.

4. The adjustable light fixture of claim 1 wherein the reflector assembly includes a frame and the adjustment mechanism is attached to the frame.

5. The adjustable light fixture of claim 4 wherein the frame is attached to the housing.

6. The adjustable light fixture of claim 5 wherein the attachment of the frame to the housing comprises a hinge.

7. The adjustable light fixture of claim 1 wherein the adjustment mechanism comprises a screw assembly.

8. The adjustable light fixture of claim 1 wherein the adjustment mechanism comprises more than one screw assemblies configured to move the reflector assembly relative to the housing.

9. The adjustable light fixture of claim 7 wherein the screw assembly is rotatable to move the reflector assembly.

10. The adjustable light fixture of claim 9 wherein the adjustment mechanism further comprises a swivel bolt and the housing and the reflector assembly are connected to the swivel bolt.

11. The adjustable light fixture of claim 4 wherein the reflector assembly includes a reflector configured to be attached to the reflector frame.

12. A light fixture comprising:

a housing having an external surface;

a lamp socket contained entirely within the housing;

a reflector contained within the housing; and an adjustment mechanism that is operable from the external surface of the housing to cause movement of the reflector relative to the housing.

13. A method of adjusting a reflector comprising:

providing a housing having an external surface;

providing a lamp socket contained entirely within the housing;

providing a reflector contained within the housing;

providing an adjustment mechanism that is operable from the external surface of the housing to cause movement of the reflector relative to the housing; and adjusting the adjustment mechanism to move the reflector.

14. An adjustable light fixture comprising:

a housing with an external surface and an interior comportment and a channel connecting the interior compartment to the external surfaces of the housing;

a lamp socket contained entirely within the housing;

a reflector assembly located within the interior compartment and comprising a frame that is hingedly attached to the housing and a reflector configured to fit within the frame; and an adjustment mechanism comprising a rotatable screw assembly that is attached to the frame, is operable from the external surface of the housing to cause movement of the reflector relative to the housing, and extends through the channel from the interior compartment to the external surface of the housing.

15. A method of adjusting a reflector assembly, the method comprising:

providing a housing having an external surface and an interior compartment;

providing a lamp socket contained entirely within the housing;

providing a reflector assembly rotatably attached to the housing within the interior compartment of the housing;

providing an adjustment mechanism that is operable from the external surface of the housing to move the reflector assembly within the interior compartment of the housing; and adjusting the adjustment mechanism to move the reflector assembly into a continuous range of operating positions.

16. The method of claim 15 wherein the adjustment mechanism is attached to the reflector assembly, and adjusting the adjustment mechanism moves the reflector assembly relative to the housing.

17. The method of claim 15 further comprising a channel through the housing connecting the interior compartment to the external surface of the housing, wherein the adjustment mechanism extends through the channel from the interior compartment of the external surface of the housing such that adjusting the adjustment mechanism comprises adjusting the adjustment mechanism from the external surface of the housing to move the reflector assembly in the interior compartment of the housing.

18. The method of claim 15 wherein the adjustment mechanism is attached to the reflector assembly and adjusting the adjustment mechanism moves the reflector assembly.

19. The method of claim 15 wherein the reflector assembly includes a frame and adjusting the adjustment mechanism moves the frame.

20. The method of claim 15 wherein the reflector assembly is hingedly attached to the housing and adjusting the adjustment mechanism hingedly moves the reflector assembly relative to the housing.

21. The method of claim 15 wherein the adjustment mechanism comprises at least one screw assembly such that adjusting the adjustment mechanism comprises rotation of the at least one screw assembly.

22. The method of claim 15 wherein the adjustment mechanism comprises two screw assemblies configured to move the reflector assembly relative to the housing such that adjusting the adjustment mechanism comprises rotating the two screw assemblies.

23. The method of claim 22 wherein the adjustment mechanism further comprises a swivel bolt connecting the housing and the reflector assembly and adjusting the adjustment mechanism swivels the reflector assembly relative to the housing.

24. The method of claim 23 wherein the adjusting the adjustment mechanism further comprises raising or lowering the reflector assembly relative to the housing.

25. A light fixture, comprising:

a housing;

a lamp socket contained entirely within the housing;

a reflector rotatably connected inside the housing; and means, operable from an external surface of the housing, for rotating the reflector relative to the housing.

26. The light fixture recited in claim 25 wherein the means for rotating the reflector relative to the housing comprises a screw extending through a wall of the housing.

27. The light fixture recited in claim 26 wherein the means for rotating the reflector relative to the housing further comprises:

a nut threaded to the screw; and a spring for urging the nut away from an interior surface of the housing.

28. The light fixture recited in claim 26 wherein the means for rotating the reflector relative to the housing further comprises:

a threaded shaft having one end for receiving the screw;

a nut threaded to the exterior of the shaft; and a spring for urging the nut away from an interior surface of the housing.

29. The light fixture recited in claim 26 further comprising means for rotatably connecting the reflector relative to the housing further comprises means for rotatably connecting an end of the screw to the reflector.

30. The light fixture recited in claim 29 wherein the means for rotatably connecting an end of the screw to the reflector includes a swivel bolt arranged between the screw and the reflector.

31. The light fixture recited in claim 30 wherein the means for rotating the reflector relative to the housing further comprises:

a nut threaded to the screw; and a spring for urging the nut away from an interior surface of the housing.

32. The light fixture recited in claim 25 wherein the means rotates the reflector into a continuous range of operating positions.

33. The light fixture recited in claim 26 wherein the means rotates the reflector into a continuous range of operating positions.

34. The light fixture recited in claim 31 wherein the means rotates the reflector into a continuous range of operating positions.

* * * * *